US011231662B2

(12) United States Patent
Choi et al.

(10) Patent No.: US 11,231,662 B2
(45) Date of Patent: Jan. 25, 2022

(54) SHUTTER STRUCTURE FOR TONER REFILL CARTRIDGE

(71) Applicant: HEWLETT-PACKARD DEVELOPMENT COMPANY, L.P., Spring, TX (US)

(72) Inventors: Woongyong Choi, Suwon (KR); Seung Gweon Lee, Pangyo (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/048,696

(22) PCT Filed: Mar. 21, 2019

(86) PCT No.: PCT/US2019/023398
§ 371 (c)(1),
(2) Date: Oct. 19, 2020

(87) PCT Pub. No.: WO2020/046424
PCT Pub. Date: Mar. 5, 2020

(65) Prior Publication Data

US 2021/0232062 A1 Jul. 29, 2021

(30) Foreign Application Priority Data

Aug. 30, 2018 (KR) ..... 10-2018-0102532

(51) Int. Cl.
*G03G 15/08* (2006.01)
*B41J 2/175* (2006.01)

(52) U.S. Cl.
CPC ..... *G03G 15/0886* (2013.01); *B41J 2/17509* (2013.01); *G03G 15/0867* (2013.01); *G03G 2215/0692* (2013.01)

(58) Field of Classification Search
CPC ..... G03G 15/0886; G03G 15/0867; G03G 2215/066; G03G 2215/0692;
(Continued)

(56) References Cited

U.S. PATENT DOCUMENTS 4,627,476 A 12/1986 Wilcke
5,441,177 A 8/1995 Yanagisawa
(Continued)

FOREIGN PATENT DOCUMENTS

CN 2831190 10/2006
CN 105319903 2/2016
(Continued)

*Primary Examiner* — Robert B Beatty
(74) *Attorney, Agent, or Firm* — Trop Pruner & Hu, P.C.

(57) ABSTRACT

A toner cartridge includes a body including a first toner discharge portion, a discharge shutter configured to rotate relative to the body about a first rotation axis to a discharge position at which toner is allowed to be discharged via the first toner discharge portion and a closed position at which the first toner discharge portion is closed, and a locking member supported by the body and configured to rotate about a second rotation axis different from the first rotation axis to a locked position at which a first interference portion of the discharge shutter located at the closed position is caught by a second interference portion, thereby not allowing the discharge shutter to rotate and an unlocked position at which the discharge shutter is allowed to rotate.

20 Claims, 13 Drawing Sheets

(58) Field of Classification Search
CPC ..... B41J 2/17503; B41J 2/17506; B41J 2/17509; B65D 39/02; B65D 39/025; B65D 47/00; B65D 47/08; B65D 55/02; B65D 83/0022; B65D 83/06; B65D 2251/1016; B65D 2555/02
USPC ..... 399/260; 347/86; 222/153.14, 325, 557, 222/559, DIG. 1
See application file for complete search history.

(56) References Cited

U.S. PATENT DOCUMENTS

| | | | | |
|---|---|---|---|---|
| 5,722,014 A | 2/1998 | Fike | | |
| 9,031,451 B2 * | 5/2015 | Rulon | G03G 15/0886 | 399/106 |
| 2021/0088939 A1 * | 3/2021 | Lee | G03G 21/1814 | |
| 2021/0116838 A1 * | 4/2021 | Ahn | G03G 21/1676 | |

FOREIGN PATENT DOCUMENTS

| | | | |
|---|---|---|---|
| CN | 107077086 | 8/2017 | |
| EP | 0112278 | 8/1986 | |
| JP | 19960152775 | 6/1996 | |
| JP | 19960179611 | 7/1996 | |
| JP | 19980260570 | 9/1998 | |
| JP | 2006065112 A * | 3/2006 | |
| JP | 2009014911 A * | 1/2009 | |
| JP | 2014125266 | 7/2014 | |
| JP | 2016011145 | 1/2016 | |
| KR | 101799088 | 11/2017 | |
| WO | WO-2020045763 A1 * | 3/2020 | G03G 15/0894 |

* cited by examiner

SHUTTER STRUCTURE FOR TONER REFILL CARTRIDGE

BACKGROUND

Printers using an electrophotographic method form a visible toner image on a photoconductor by supplying toner to an electrostatic latent image formed on the photoconductor, transfer the toner image to a printing medium via an intermediate transfer medium or directly transfer the toner image to the printing medium, and then fix the transferred toner image on the printing medium.

A developing cartridge accommodates toner, and the toner from the developing cartridge is supplied to an electrostatic latent image formed on a photoconductor, thereby forming a visible toner image. When the toner accommodated in the developing cartridge is consumed, the developing cartridge is detached from a main body of a printer, and a new developing cartridge may be installed in the main body. The developing cartridge may be refilled with new toner by using a toner refilling kit (toner refilling cartridge).

DETAILED DESCRIPTION

Figure 1:
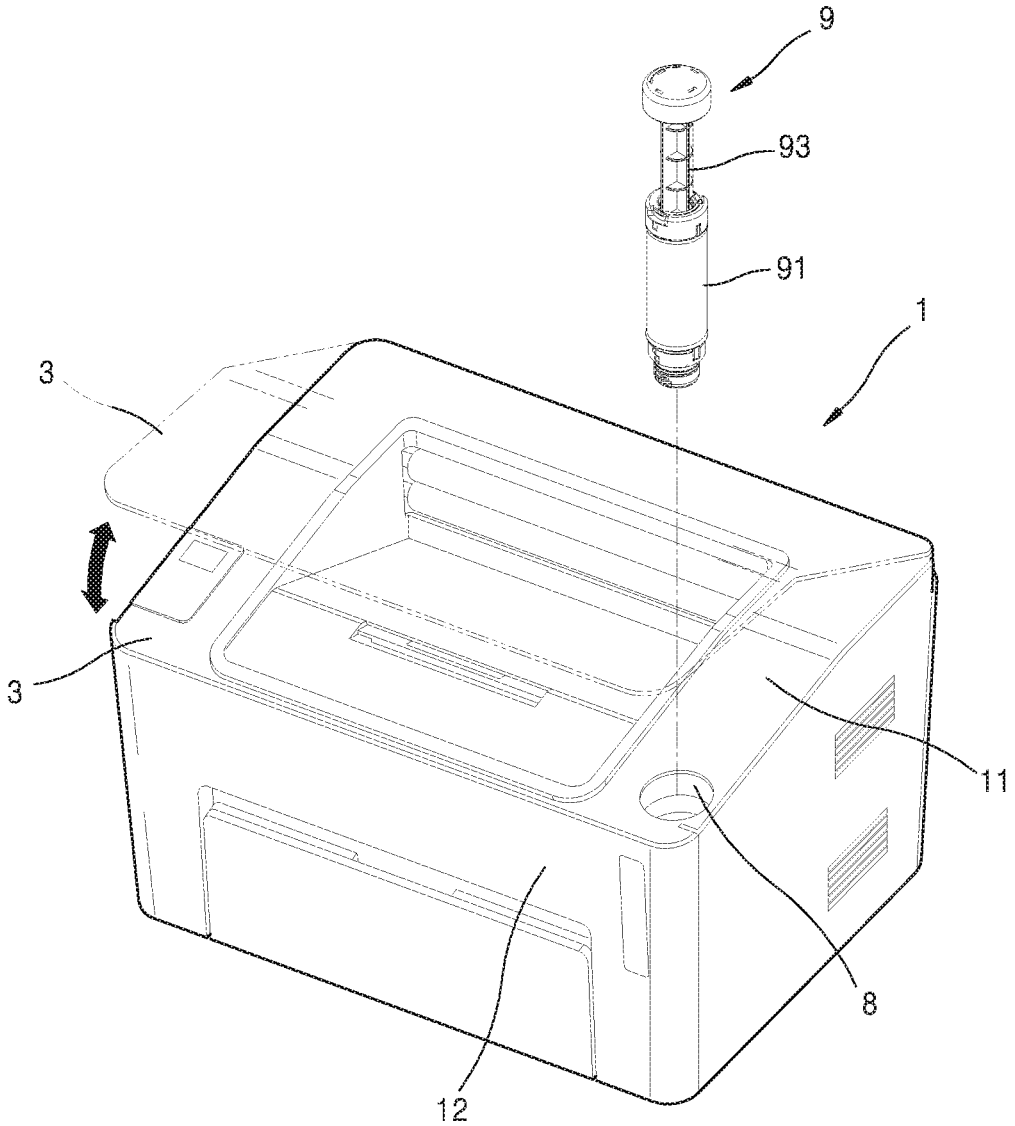
FIG. 1 is a schematic appearance perspective view illustrating an example of an electrophotographic printer.
Figure 2:
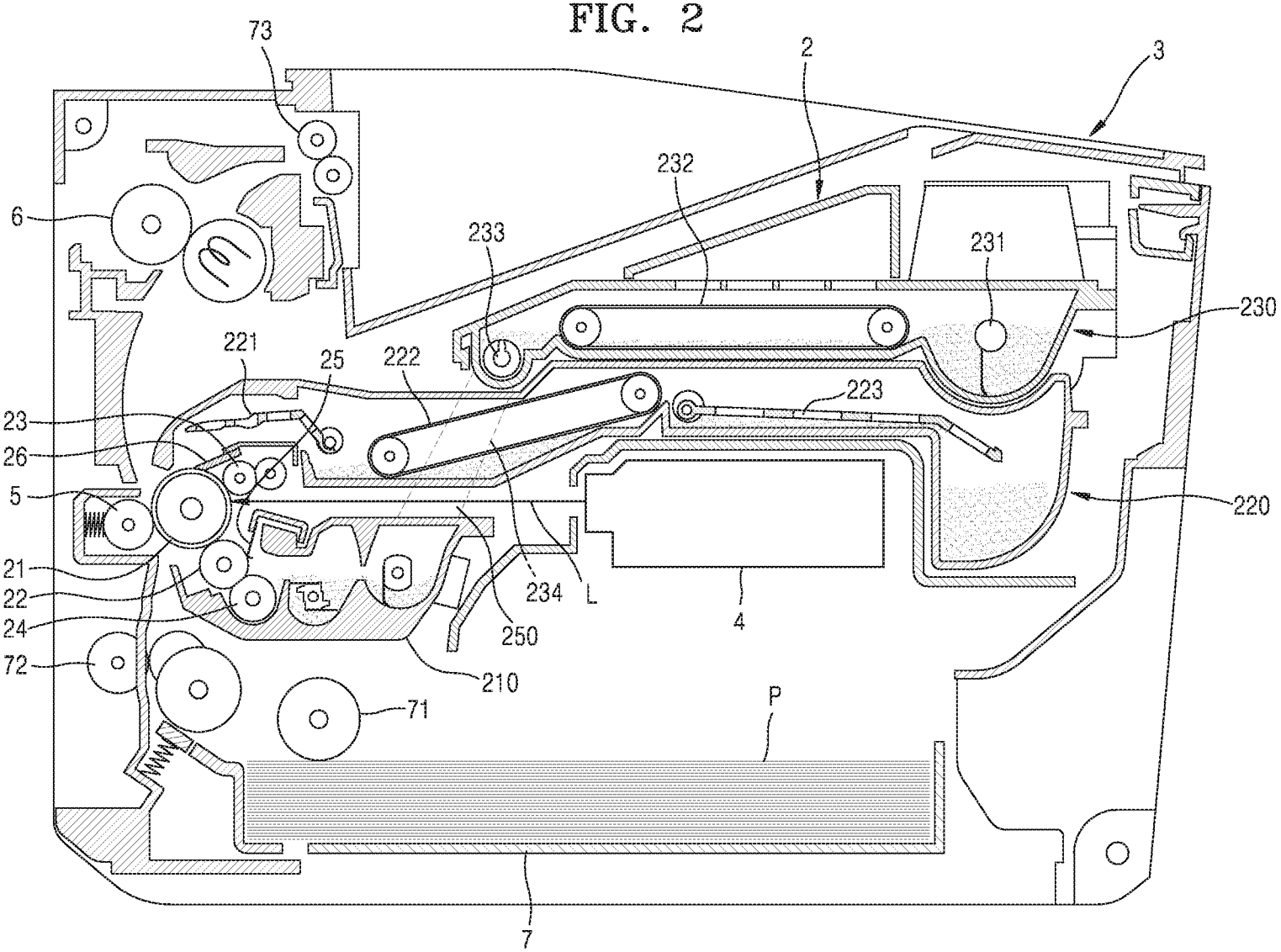
FIG. 2 is a schematic configurational view of the example of the electrophotographic printer illustrated in FIG. 1.
Figure 3:
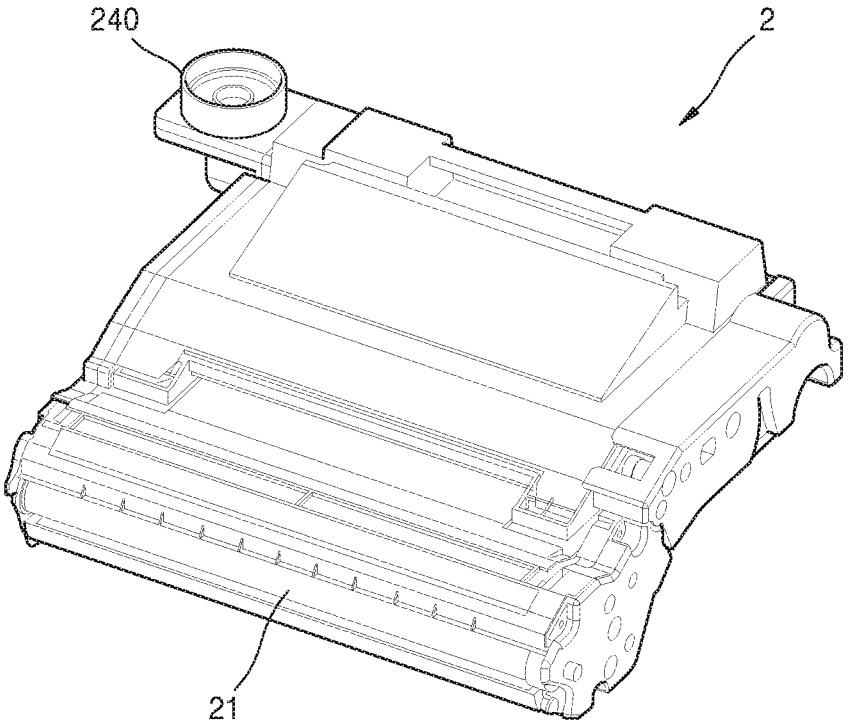
FIG. 3 is a perspective view of an example of a developing cartridge used in the example of the electrophotographic printer illustrated in FIG. 1.

FIG. 1 is a schematic appearance perspective view illustrating an example of an electrophotographic printer. FIG. 2 is a schematic configurational view of the example of the electrophotographic printer illustrated in FIG. 1. FIG. 3 is a perspective view of an example of a developing cartridge used in the example of the electrophotographic printer illustrated in FIG. 1. Referring to FIGS. 1, 2, and 3, the electrophotographic printer may include a main body 1 and a developing cartridge 2 detachably installed in the main body 1. A door 3 may be installed in the main body 1. The door 3 partially opens or closes the main body 1. Although FIG. 1 illustrates that the door 3 is configured to open an upper portion of the main body 1, the door 3 may also be configured to open a side portion or a front portion of the main body 1. After the door 3 is opened, the developing cartridge 2 may be installed/detached at/from the main body 1.

A photosensitive drum 21 is an example of a photoconductor on which an electrostatic latent image is formed and may include a cylindrical metal pipe and a photosensitive layer that is formed on an outer circumferential surface of the cylindrical metal pipe and has photoconductivity. A charging roller 23 is an example of a charger for charging a surface of the photosensitive drum 21 with uniform electric potential. A charging bias voltage is applied to the charging roller 23. A corona charger (not shown) may also be used instead of the charging roller 23. A developing roller 22 supplies toner to an electrostatic latent image formed on the surface of the photosensitive drum 21 and develops the image.

In the case of a two-component developing method, wherein toner and carrier are used as a developer, the developing roller 22 may be in a form in which a magnet is fixedly installed in a rotating sleeve. The sleeve may be placed apart at a distance of several tens to several hundreds of micrometers from the photosensitive drum 21. The carrier is attached to an outer circumference of the developing roller 22 by a magnetic force of the magnet, and the toner is attached to the carrier by electrostatic force, thereby forming a magnetic brush formed of the carrier and the toner on the outer circumference of the developing roller 22. The toner is transferred onto the electrostatic latent image formed on the photosensitive drum 21 by a developing bias voltage applied to the developing roller 22.

In the case of a one-component developing method wherein toner is used as a developer, the developing roller 22 may come into contact with the photosensitive drum 21 and may be placed apart at a distance of several tens to several hundreds of micrometers from the photosensitive drum 21. In the example, a one-component contact developing method, in which the developing roller 22 and the photosensitive drum 21 come into contact with each other, thus forming a development nip, is used. The developing roller 22 may include an elastic layer (not shown) formed on an outer circumferential surface of a conductive metal core (not shown). When a developing bias voltage is applied to the developing roller 22, toner is transferred and attached to the electrostatic latent image formed on the surface of the photosensitive drum 21 via the development nip.

A supply roller 24 attaches toner to the developing roller 22. To attach toner to the developing roller 22, a supply bias voltage may be applied to the supply roller 24. Reference numeral 25 denotes a regulator configured to regulate the amount of toner attached to a surface of the developing roller 22. The regulator 25 may be, for example, a regulating blade, a tip end of which comes into contact with the developing roller 22 by a predetermined pressure. Reference numeral 26 denotes a cleaning member configured to remove residual toner and foreign matter from the surface of the photosensitive drum 21 before charging. The cleaning member 26 may be, for example, a cleaning blade, a tip end of which comes into contact with the surface of the photosensitive drum 21. Hereinafter, the foreign matter removed from the surface of the photosensitive drum 21 is referred to as waste toner.

An optical scanner 4 scans light modulated in accordance with image information onto the surface of the photosensitive drum 21 charged with uniform electric potential. The optical scanner 4 may be, for example, a laser scanning unit (LSU) configured to deflect light emitted from a laser diode in a main scanning direction by using a polygon mirror and scan the deflected light onto the photosensitive drum 21.

A transfer roller 5 is an example of a transfer unit placed opposite the photosensitive drum 21 and configured to form a transfer nip. A transfer bias voltage is applied to the transfer roller 5 so as to transfer a toner image developed on the surface of the photosensitive drum 21 to a printing medium P. Instead of the transfer roller 5, a corona transfer unit may also be used.

The toner image, which is transferred to a surface of the printing medium P by the transfer roller 5, is maintained on the surface of the printing medium P by electrostatic attraction. A fuser 6 fixes the toner image onto the printing medium P by applying heat and pressure thereto, thus forming a permanent printed image on the printing medium P.

Referring to FIGS. 2 and 3, the developing cartridge 2 of the example includes a developing portion 210 in which the photosensitive drum 21 and the developing roller 22 are installed, a waste toner container 220 configured to accommodate waste toner removed from the photosensitive drum 21, and a toner container 230 connected to the developing portion 210 and configured to accommodate toner. To refill the toner container 230 with toner, the developing cartridge 2 includes a toner refilling portion 240 connected to the toner container 230. The toner refilling portion 240 provides an interface between a toner cartridge 9, which will be described below, and the developing cartridge 2. The developing cartridge 2 is an integrated-type developing cartridge including the developing portion 210, the waste toner container 220, the toner container 230, and the toner refilling portion 240.

A portion of an outer circumference of the photosensitive drum 21 is exposed to the outside of a housing. The exposed portion of the photosensitive drum 21 comes into contact with the transfer roller 5, thereby forming a transfer nip. The developing portion 210 may include at least one conveying member configured to convey toner towards the developing roller 22. The conveying member may also serve to charge toner with a predetermined electric potential by stirring the toner.

The waste toner container 220 is located on an upper side of the developing portion 210. The waste toner container 220 is spaced apart from the developing portion 210 in an upward direction, and a light path 250 is formed therebetween. The waste toner, which is removed from the photosensitive drum 21 by the cleaning member 26, is accommodated in the waste toner container 220. The waste toner removed from the surface of the photosensitive drum 21 is transported into the waste toner container 220 by one or more waste toner transporting members 221, 222, and 223. The type and number of waste toner transporting members are not limited. According to the volume or type of the waste toner container 220, an appropriate number of waste toner transporting members may be installed at an appropriate position allowing waste toner to be effectively dispersed in the waste toner container 220.

The toner container 230 is connected to the toner refilling portion 240 to accommodate toner. As illustrated by dotted lines in FIG. 2, the toner container 230 is connected to the developing portion 210 via a toner supply unit 234. As illustrated in FIG. 2, the toner supply unit 234 may be connected to the developing portion 210 by passing through the waste toner container 220 vertically. The toner supply unit 234 is placed outside an effective width of an exposed light L so as not to interfere with the exposed light L injected in a main scanning direction by the optical scanner 4.

The toner container 230 may be provided with one or more toner supply members 231, 232, and 233 configured to supply toner to the developing portion 210 via the toner supply unit 234. The type and number of toner supply members are not limited. According to the volume or type of the toner container 230, an appropriate number of toner supply members may be installed at an appropriate position in the toner container 230 so as to effectively supply toner to the developing portion 210. The toner supply member 233 may convey toner in a main scanning direction and transfer the toner to the toner supply unit 234.

An image forming process will be briefly described using the above-described configurations. A charging bias is applied to the charging roller 23, and the photosensitive drum 21 is charged with uniform electric potential. The optical scanner 4 scans light modulated in response to image information to the photosensitive drum 21 to thereby form an electrostatic latent image on the surface of the photosensitive drum 21. The supply roller 24 attaches toner to the surface of the developing roller 22. The regulator 25 forms a toner layer having a uniform thickness on the surface of the developing roller 22. A developing bias voltage is applied to the developing roller 22. As the developing roller 22 is rotated, toner transported to a developing nip is transferred and attached onto the electrostatic latent image formed on the surface of the photosensitive drum 21 by the developing bias voltage, thereby forming a visible toner image on the surface of the photosensitive drum 12. The printing medium P taken out of a loading tray 7 by a pickup roller 71 is transferred to a transfer nip configured such that the transfer roller 5 and the photosensitive drum 21 face each other, by a transporting roller 72. When a transfer bias voltage is applied to the transfer roller 5, the toner image is transferred onto the printing medium P by electrostatic attraction. The toner image transferred onto the printing medium P is fixed on the printing medium P by receiving heat and pressure from the fuser 6, thus completing printing. The printing medium P is discharged by a discharge roller 73. Toner that is not transferred onto the printing medium P and remains on the surface of the photosensitive drum 21 is removed by the cleaning member 26.

As described above, the developing cartridge 2 of the example includes the toner refilling portion 240 for refilling toner. According to the printer of the example, the developing cartridge 2 may be refilled with toner in a state in which the developing cartridge 2 is installed in the main body 1 without being detached from the main body 1.

Referring to FIG. 1, the main body 1 includes a communicating portion 8 to allow an access to the toner refilling portion 240 from the outside of the main body 1 in a state in which the developing cartridge 2 is installed in the main body 1. For example, when the toner cartridge (toner charging kit) 9, in which toner is accommodated, is inserted into the communicating portion 8, the toner cartridge 9 may be connected to the toner refilling portion 240. In this state, the toner container 230 may be filled with the toner from the toner cartridge 9 via the toner refilling portion 240. The toner cartridge 9 is detached from the communicating portion 8 after toner refilling is completed.

By using the above-described configurations, the toner container 230 may be refilled with toner via the toner refilling portion 240, and thus the replacement time of the developing cartridge 2 may be extended until the lifetime of the photosensitive drum 21 ends, thus reducing the printing costs per sheet of paper. Since toner refilling is possible in a state in which the developing cartridge 2 is installed in the main body 1, user convenience may be enhanced.

The communicating portion 8 may be provided at a position close to a front portion 12 (see FIG. 1) of the main body 1. The front portion 12 faces a user, and thus the user may easily access the communicating portion 8. Thus, a toner refilling operation may be easily performed via the communicating portion 8.

The communicating portion 8 may be provided at an upper surface 11 of the main body 1. The toner refilling portion 240 is located below the communicating portion 8. The communicating portion 8 and the toner refilling portion 240 may be vertically aligned with respect to each other. The toner cartridge 9 may provide access to the toner refilling portion 240 via the communicating portion 8 from the upper side of the main body 1. For example, when the toner cartridge 9 is inserted into the communicating portion 8 from the upper side of the main body 1, the toner cartridge 9 may be connected to the toner refilling portion 240.

Figure 4:
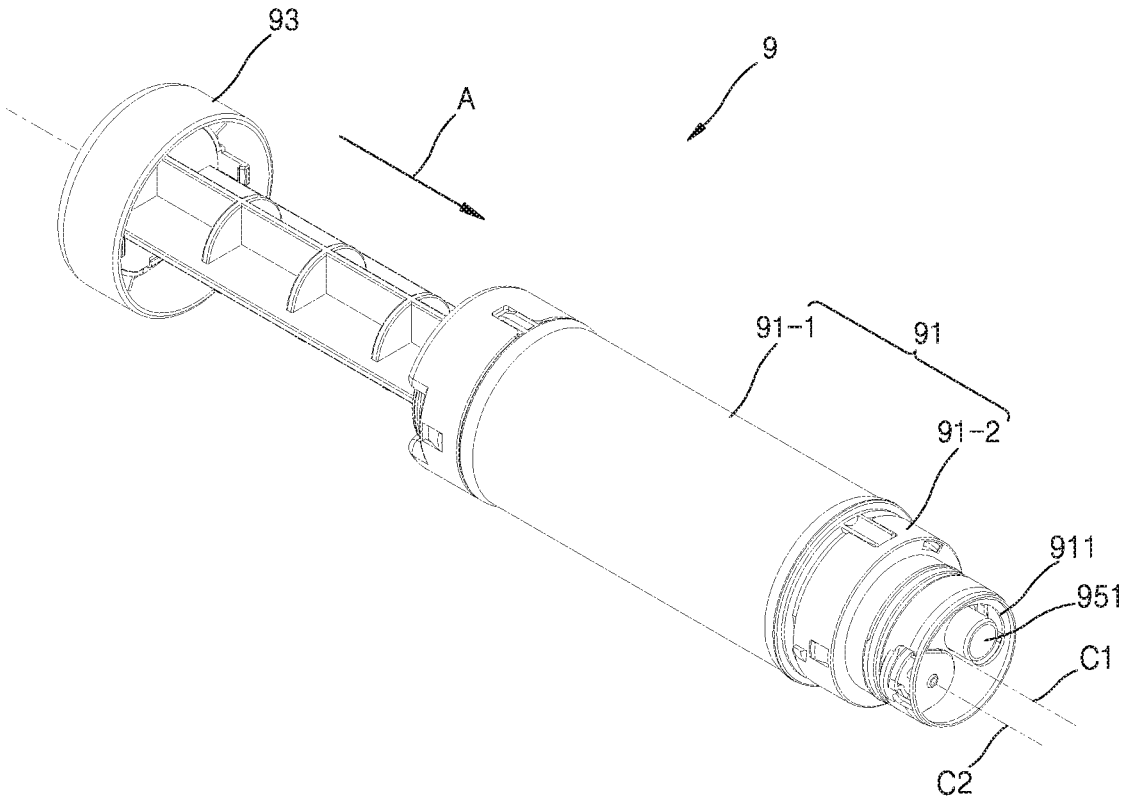
FIG. 4 is a perspective view of an example of a toner cartridge.
Figure 5:
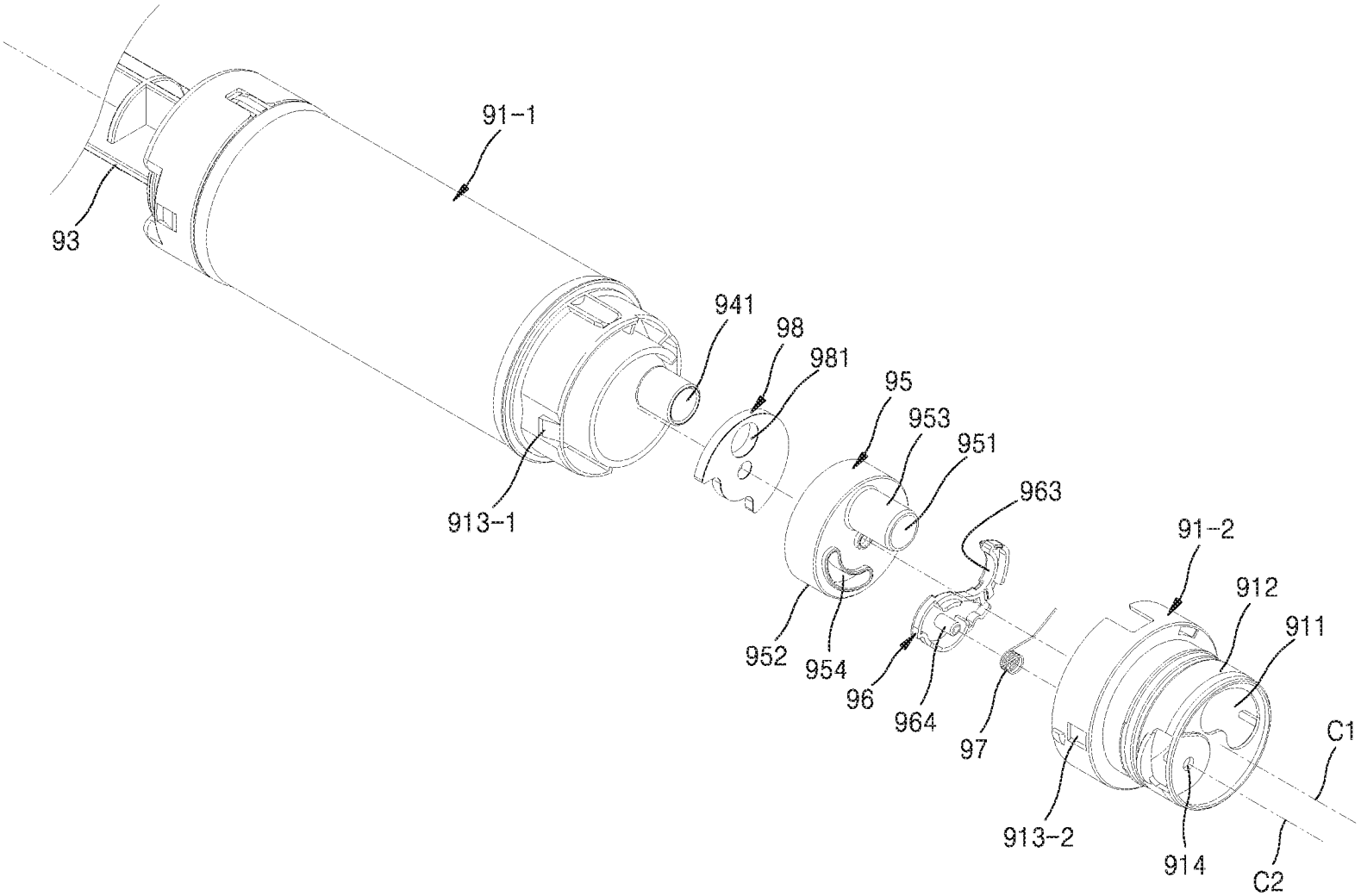
FIG. 5 is an exploded perspective view of an example of a toner cartridge.
Figure 6:
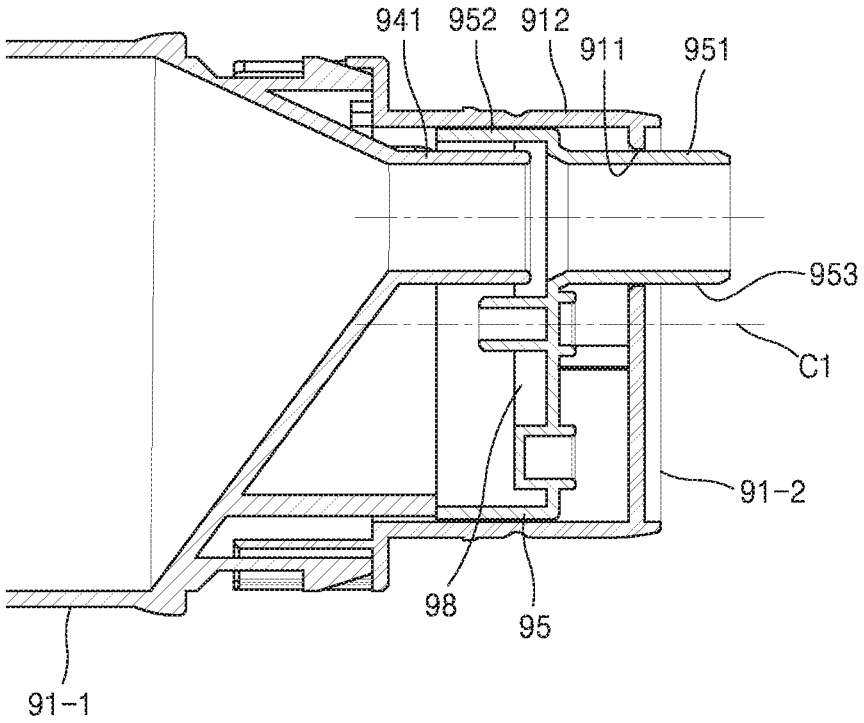
FIG. 6 is a partial cross-sectional view illustrating a state in which a discharge shutter is located at a discharge position.
Figure 7:
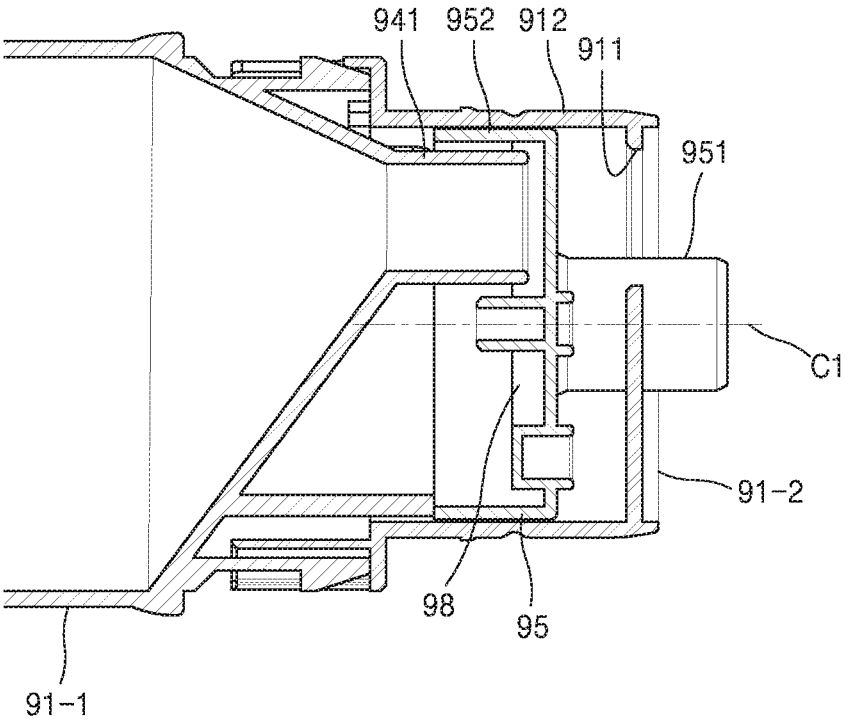
FIG. 7 is a partial cross-sectional view illustrating a state in which a discharge shutter is located at a closed position.
Figure 8:
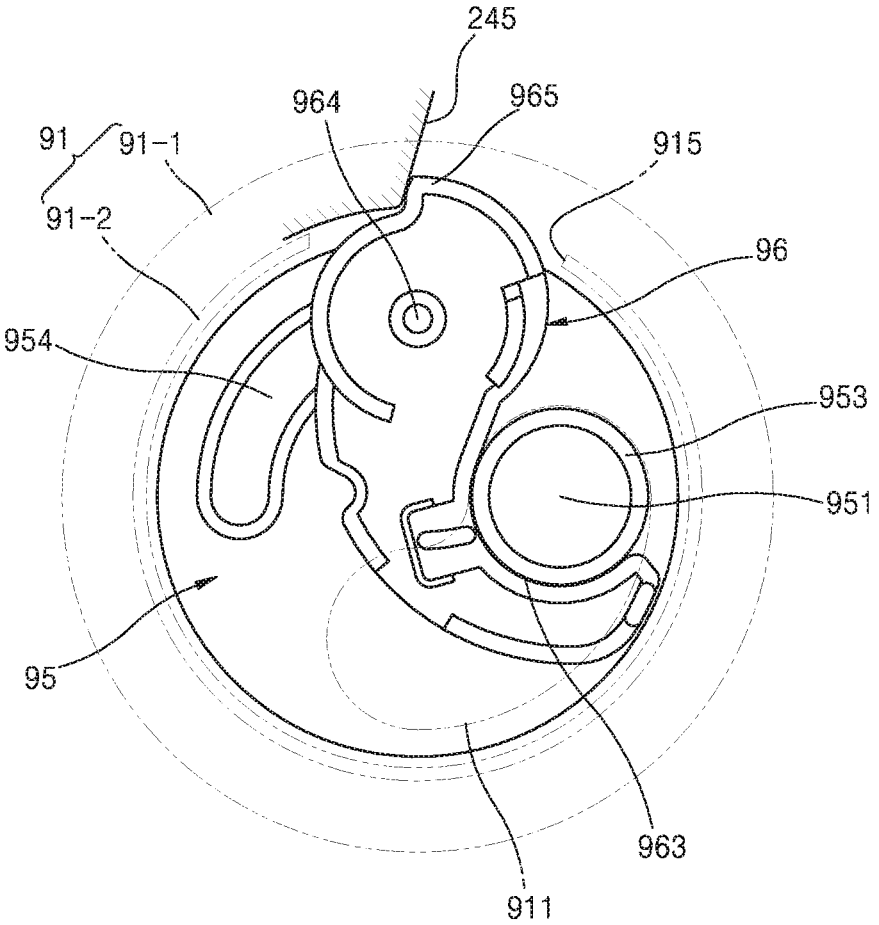
FIG. 8 is a front view illustrating a state in which a locking member is located at a locked position.
Figure 9:
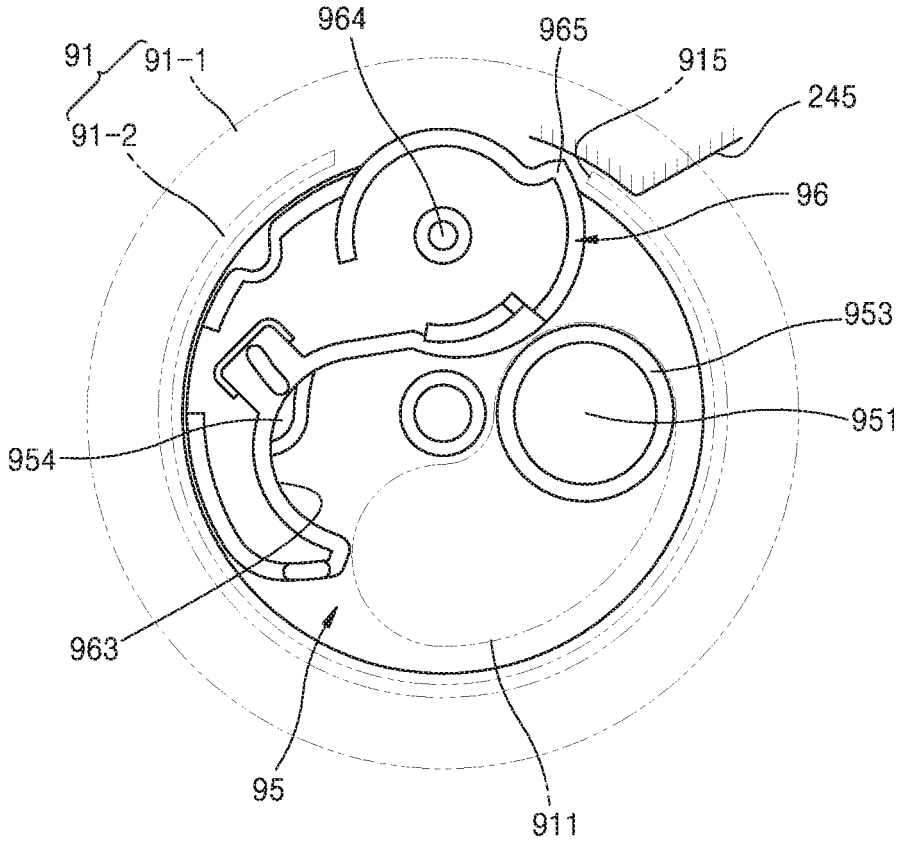
FIG. 9 is a front view illustrating a state in which a locking member is located at an unlocked position.

FIG. 4 is a perspective view of an example of the toner cartridge 9. FIG. 5 is an exploded perspective view of an example of the toner cartridge 9. FIG. 6 is a partial cross-sectional view illustrating a state in which a discharge shutter 95 is located at a discharge position. FIG. 7 is a partial cross-sectional view illustrating a state in which the discharge shutter 95 is located at a closed position. FIG. 8 is a front view illustrating a state in which a locking member 96 is located at a locked position. FIG. 9 is a front view illustrating a state in which the locking member 96 is located at an unlocked position. Examples of the toner cartridge 9 will be described with reference to FIGS. 4 to 9.

The toner cartridge 9 may be a syringe-type toner refilling cartridge including a body 91 configured to contain toner and a plunger 93 movably coupled to the body 91 in a longitudinal direction A and configured to push toner towards the outside of the body 91. The toner cartridge 9 may include the body 91, the discharge shutter 95, the locking member 96, and a locking spring 97.

The body 91 may accommodate toner and include a first toner discharge portion 941 eccentrically located with respect to a first rotation axis C1 and configured to discharge toner. The body 91 may have, for example, a cylindrical shape. The first rotation axis C1 may be a central axis of the body 91 having a cylindrical shape. As described below, the first rotation axis C1 may be a rotational central axis when the toner cartridge 9 is installed at the toner refilling portion 240 and is rotated.

The body 91 may include a first body 91-1 in which toner is accommodated and the first toner discharge portion 941 is provided, and a second body 91-2 coupled to the first body 91-1 such that the discharge shutter 95 is disposed between the second body 91-2 and the first body 91-1. The second body 91-2 may be coupled to a front portion of the first body 91-1. For example, the first body 91-1 may be snap-fit coupled to the second body 91-2. For this, a hook 913-1 may be provided at the first body 91-1 and a locking groove 913-2 caught by the hook 913-1 may be provided at the second body 91-2. The first toner discharge portion 941 may extend from the first body 91-1 towards the discharge shutter 95.

The discharge shutter 95 may be rotated relative to the body 91 about the first rotation axis C1 to a discharge position (see FIG. 6) allowing the discharge of toner via the first toner discharge portion 941 and to a closed position allowing the first toner discharge portion 941 to be closed (see FIG. 7). For example, the discharge shutter 95 may include a second toner discharge portion 951. The discharge shutter 95 may be rotated relative to the body 91 about the first rotation axis C1 to the discharge position (see FIG. 6) which allows the discharge of toner since the first toner discharge portion 941 and the second toner discharge portion 951 are aligned with respect to each other. The discharge shutter 95 may be rotated relative to the body 91 about the first rotation axis C1 to a closed position (see FIG. 7) allowing the first toner discharge portion 941 to be closed since the first toner discharge portion 941 is not aligned with the second toner discharge portion 951. The first toner discharge portion 941 and the second toner discharge portion 951 may be eccentrically located by the same distance from the first rotation axis C1 in a radius direction. The discharge shutter 95 may be rotated relative to the body 91 about the first rotation axis C1 to switch to the closed position and the discharge position. When the plunger 93 is pressed in a state in which the discharge shutter 95 is located at the discharge position, toner inside the body 91 may be discharged to the outside of the body 91 via the first toner discharge portion 941 and the second toner discharge portion 951. Even if the plunger 93 is pressed in a state in which the discharge shutter 96 is located at the closed position, the first toner discharge portion 941 is closed by the discharge shutter 95, and thus the toner is unable to be discharged outside of the body 91.

The discharge shutter 95 may be rotatably supported by, for example, the second body 91-2. For example, an outer support portion 912, which is cylindrical, based on the first rotation axis C1 may be provided in the second body 91-2, and an inner support portion 952 rotatably supported by an inner side of the outer support portion 912 may be provided in the discharge shutter 95.

The second toner discharge portion 951 may extend outward from the body 91 and protrude outside of the body 91. The second body 91-2 is provided therein with a through-hole portion 911 allowing the second toner discharge portion 951 to protrude outside of the body 91 therethrough. The through-hole portion 911 may take a form that restricts a relative rotation angle of the discharge shutter 95 with respect to the body 91. For example, the through-hole portion 911 may have a circular arc shape based on the first rotation axis C1. One end portion and another end portion of the through-hole portion 911 may respectively correspond to the closed position and discharge position of the discharge shutter 95. When the discharge shutter 95 reaches the closed position, the second toner discharge portion 951 is caught by the one end portion of the through-hole portion 911, and thus is no longer rotated. When the discharge shutter 95 reaches the discharge position, the second toner discharge portion 951 is caught by the other end portion of the through-hole portion 911, and thus is no longer rotated.

A sealing member 98 may be disposed between the first body 91-1 and the discharge shutter 95. The sealing member 98 may be rotated relative to the body 91 along with the discharge shutter 95. A through-hole 981 aligned with the second toner discharge portion 951 is provided in the sealing member 98. The sealing member 98 seals the first toner discharge portion 941 between the closed position and discharge position of the discharge shutter 95. When the discharge shutter 95 is located at the discharge position, the first toner discharge portion 941, the through-hole 981, and the second toner discharge portion 951 may be aligned with respect to one another such that toner is discharged outside of the body 91. When the discharge shutter 95 escapes from the discharge position, the first toner discharge portion 941 is sealed by the sealing member 98. By adopting the sealing member 98, the leakage of toner between the first body 91-1 and the discharge shutter 95 may be prevented.

The locking member 96 is supported by the body 91 and is rotatable about a second rotation axis C2, which is different from the first rotation axis C1, to a locked position (see FIG. 8) at which the discharge shutter 95 is allowed to be locked at the closed position and an unlocked position (see FIG. 9) at which the discharge shutter 95 is allowed to rotate to the discharge position.

In one example, the discharge shutter 95 may include a first interference portion 953. The locking member 96 may include a second interference portion 963 corresponding to the first interference portion 953. The locking member 96 is supported by the body 91 and is rotatable about the second rotation axis C2, which is different from the first rotation axis C1, to the locked position (see FIG. 8) at which the first interference portion 953 of the discharge shutter 95 located at the closed position is caught by the second interference portion 963, thereby not allowing the discharge shutter 96 to rotate and the unlocked position (see FIG. 9) at which the discharge shutter 95 is allowed to rotate. The locking spring 97 applies an elastic force to the locking member 96 in a direction returning to the locked position from the unlocked position.

The locking member 96 may be rotated relative to the body 91 about the second rotation axis C2 to switch to the locked position and the unlocked position. When the locking member 96 is located at the locked position, the first interference portion 953 is caught by the second interference portion 963, and thus the discharge shutter 95 is unable to be rotated to the discharge position and maintained at the closed position. The locking member 96 locks the discharge shutter 95 in a state of being located at the closed position before the toner cartridge 9 is installed at the toner refilling portion 240. Accordingly, unintended toner leakage may be prevented. When the locking member 96 is located at the unlocked position, the second interference portion 963 may be spaced apart from the first interference portion 953, and the discharge shutter 95 may be rotated to the discharge position from the closed position.

In one example, the locking member 96 may include a support shaft 964 extending along the second rotation axis C2 and having an end portion rotatably supported by the second body 91-2. A support hole 914 through which the end portion of the support shaft 964 is inserted and by which the end portion thereof is rotatably supported may be provided in the second body 91-2. A support portion 954 by which another end portion of the support shaft 964 is rotatably supported is provided in the discharge shutter 95. Since the discharge shutter 95 is rotated about the first rotation axis C1 to the closed position and the discharge position, this corresponds to a case in which the locking member 96 is rotated relative to the discharge shutter 95 about the first rotation axis C1. Thus, the support portion 954 may have a circular arc shape allowing relative rotation of the locking member 95 with respect to the first rotation axis C1. The support portion 954 supports the other end portion of the support shaft 964 such that the end portion of the support shaft 964 does not escape from the support hole 914. Due to such a configuration, a separate support member not allowing the end portion of the support shaft 964 to escape from the support hole 914 may not be adopted, and thus the toner cartridge 9 may have a simplified structure and the number of assembly processes is decreased, thus reducing cost of the toner cartridge 9.

The locking member 96 may include an external force receiver 965 exposed to the outside of the body 91 so as to receive an external force for switching to the unlocked position from the locked position. For example, a through groove 915 may be provided at a side portion of the second body 91-2, and the external force receiver 965 may be exposed to the outside of the second body 91-2 via the through groove 915. When the toner cartridge 9 is installed at the toner refilling portion 240, the external force receiver 965 may be interfered with a releasing portion 245 provided in the toner refilling portion 240. In one example, the toner cartridge 9 may be installed at the toner refilling portion 240 and may be rotated about the first rotation axis C1, and at this time, the external force receiver 965 may be interfered with by the releasing portion 245 so that the locking member 96 switches to the unlocked position from the locked position.

The locking spring 97 may have various shapes, for example, a coil spring, a leaf spring, an elastic arm formed integrally with the locking member 96, and the like. In the example, the locking member 96 is realized by a torsion coil spring having a central coil winding portion installed on the support shaft 964, an end portion supported by the locking member 96, and another end portion supported by the second body 91-2.

When the elastic force of the locking spring 97 is strong, the locking spring 97 may stably maintain the locking member 96 at the locked position, while a great force is needed to switch the locking member 96 to the unlocked position from the locked position. For example, a great force is needed to rotate the toner cartridge 9 after the toner cartridge 9 is installed at the toner refilling portion 240. In contrast, if the elastic force of the locking spring 97 is weak, the locking member 96 may switch to the unlocked position from the locked position with a weak force, but the locking member 96 may switch to the unlocked position by external impact or a small force. For example, once the locking member 96 switches to the unlocked position by a small rotational force applied to the discharge shutter 95, the discharge shutter 95 switches to the discharge position, and thus toner may be leaked unintentionally.

According to the example, the locking member 96 is rotated with respect to the second rotation axis C2 different from the first rotation axis C1, which is a rotation axis of the discharge shutter 95. By appropriately determining the position of the second rotation axis C2, the elastic force of the locking spring 97 may be reduced and the locking member 96 may be stably maintained at the locked position.

Figure 10:
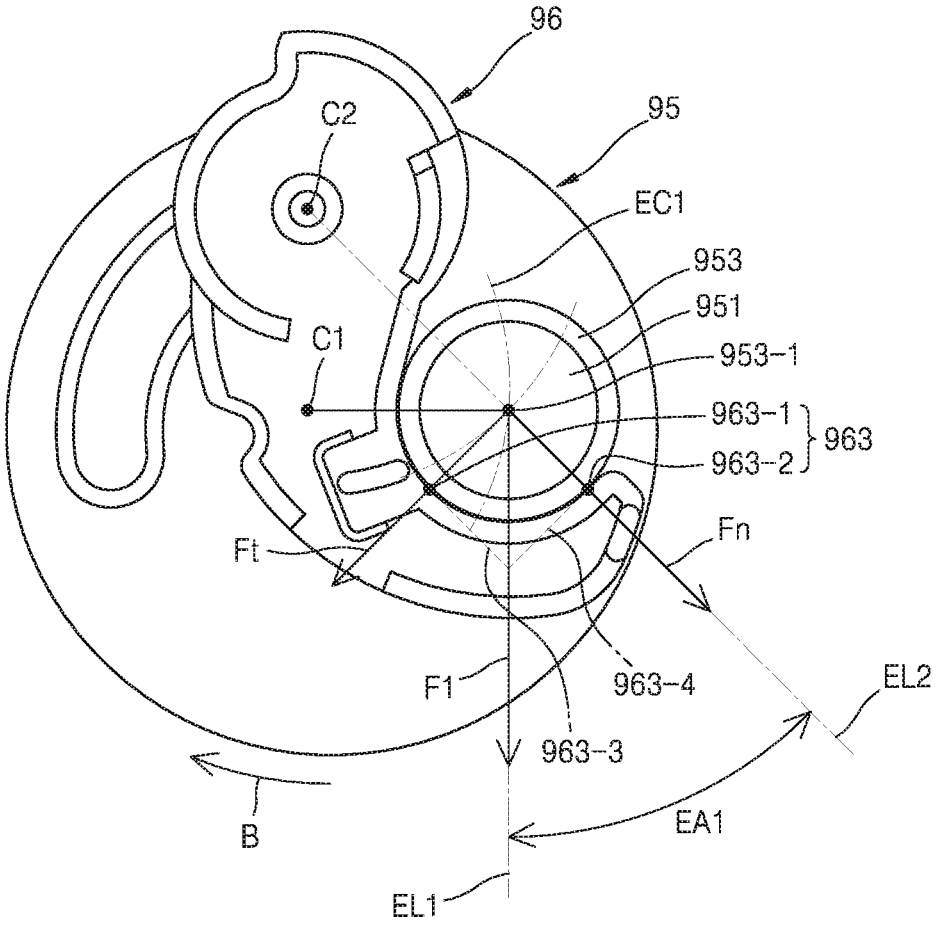
FIG. 10 is a front view illustrating an example of the position of a second rotational axis.

FIG. 10 is a front view illustrating an example of the position of the second rotation axis C2. Referring to FIG. 10, the position of the second rotation axis C2 may be determined such that, when the discharge shutter 95 is rotated to the discharge position from the closed position in a state in which the locking member 96 is located at the locked position, a normal component Fn based on the second rotation axis C2 of a force F1 applied to the locking member 96 by the discharge shutter 95 is directed in an opposite direction of the second rotation axis C2. In other words, the position of the second rotation axis C2 may be determined such that, when the discharge shutter 95 is rotated to the discharge position from the closed position in a state in which the locking member 96 is located at the locked position, the normal component Fn based on the second rotation axis C2 of the force F1 applied to the second interference portion 963 by the first interference portion 953 is directed in an opposite direction of the second rotation axis C2.

For example, the first interference portion 953 may have a cylindrical form that is concentric with the second toner discharge portion 951. The second interference portion 963 may have a concave shape corresponding to the first interference portion 953. When an external force rotating in a direction B is applied to the discharge shutter 95 in a state in which the locking member 96 is located at the locked position, due to the external force, the force F1 acts on the second interference portion 963 by the first interference portion 953. A direction of the force F1 is a tangential direction based on the first rotation axis C1. The force F1 has a tangential component Ft and the normal component Fn, based on the second rotation axis C2. The tangential component Ft acts as a force for rotating the locking member 96 around the second rotation axis C2 to the unlocked position. The normal component Fn acts as a force for pushing the locking member 96 towards the second rotation axis C2 or in an opposite direction of the second rotation axis C2. When the normal component Fn is directed towards the second rotation axis C2, the locking member 96 may be rotated about the second rotation axis C2 to the unlocked position. On the other hand, when the normal component Fn is directed in an opposite direction of the second rotation axis C2, the normal component Fn acts as a force for hindering the rotation of the locking member 96 to the unlocked position, and the second interference portion 963 acts as a wedge so that the locking member 96 is unable to be rotated to the unlocked position.

The second interference portion 963 may include a first contact portion 963-1 and a second contact portion 963-2 that come into contact with the first interference portion 953. The second contact portion 963-2 comes into contact with the first interference portion 953 at a position farther from the second rotation axis C2 than the first contact portion 963-1. The second contact portion 963-2 comes into contact with the first interference portion 953 on an opposite side of the second rotation axis C2 with respect to a center 953-1 of the first interference portion 953. For example, the second interference portion 963 may have a concave partial cylindrical shape extending from the first contact portion 963-1 to the second contact portion 963-2. The position of the second contact portion 963-2 may be determined such that the second interference portion 963 acts as a wedge by receiving the normal component Fn. The second contact portion 963-2 comes into contact with the first interference portion 953 at a position apart by an angle of 45° or greater with respect to the tangential component Ft of the force F1, based on the center 953-1 of the first interference portion 953. The second contact portion 963-2 may come into contact with the first interference portion 953 at a position apart by an angle of about 45° to about 90° from the tangential component Ft, based on the center 953-1 of the first interference portion 953. In other words, assuming that a circle based on the first rotation axis C1 and passing the center 953-1 of the first interference portion 953 is denoted as EC1, the second contact portion 963-2 comes into contact with the first interference portion 953 in an external area EA1 of a line EL1 that passes the center 953-1 of the first interference portion 953 and is tangent to the circle EC1. The external area EA1 may be an area between the line EL1 and a line EL2 that passes the second rotation axis C2 and the center 953-1 of the first interference portion 953.

In the example, the second contact portion 963-2 is located at a position apart by 90 degrees from the tangential component Ft. Due to such a configuration, although the force F1 acts on the locking member 96, the second interference portion 963 acts as a wedge, and thus the locking member 96 may be maintained at the locked position.

As long as the first contact portion 963-1 comes into contact with the first interference portion 953 at a position closer to the second rotation axis C2 than the second contact portion 963-2, the position of the first contact portion 963-1 is not limited. The first contact portion 963-1 may come into contact with the first interference portion 953 at a position sufficiently apart from the second contact portion 963-2. The first contact portion 963-1 may be located at a position so as not to be caught by the first interference portion 953 when the locking member 96 is rotated to the unlocked position from the locked position. The first contact portion 963-1 may be outside the external area EA1 or inside the external area EA1.

As illustrated by dotted lines in FIG. 10, the second interference portion 963 may include first and second contact surfaces 963-3 and 963-4 that come into contact with the first interference portion 953 in the first contact portion 963-1 and the second contact portion 963-2, respectively. In the example, although a case in which the first interference portion 953 has a cylindrical shape has been described, the first interference portion 953 may have a polygonal shape. In this case, the center 953-1 of the first interference portion 953 may refer to the center of a circle inscribed in or circumscribed about the polygonal shape, or the center of a circle by which the polygonal shape is approximated.

According to the foregoing example, although the force F1 acts on the locking member 96 by the discharge shutter 95 in a state in which the locking member 96 is located at the locked position, the first interference portion 953 and the second interference portion 963 act as a wedge with respect to each other, and thus the locking member 96 may be maintained at the locked position. The locking spring 97 applies, to the locking member 96, an elastic force sufficient to switch to the locked position from the unlocked position, and thus the elastic force of the locking spring 97 may be small. Thus, even when external impact or vibration is applied to the discharge shutter 95 in a state in which the discharge shutter 95 is located at the closed position, the discharge shutter 95 may be stably maintained at the closed position, thus effectively preventing toner leakage. Even in a structure enabling an external force to act on the second toner discharge portion 951 since the second toner discharge portion 951 protrudes outside of the body 91, the leakage of toner may be effectively prevented. In addition, when the toner cartridge 9 is not installed at the toner refilling portion 240, a user is unable to arbitrarily switch the discharge shutter 95 to the discharge position, whereas, when the toner cartridge 9 is installed at the toner refilling portion 240, the locking member 96 may switch to the unlocked position even with a very small force, thereby switching the discharge shutter 95 to the discharge position.

Figure 11:
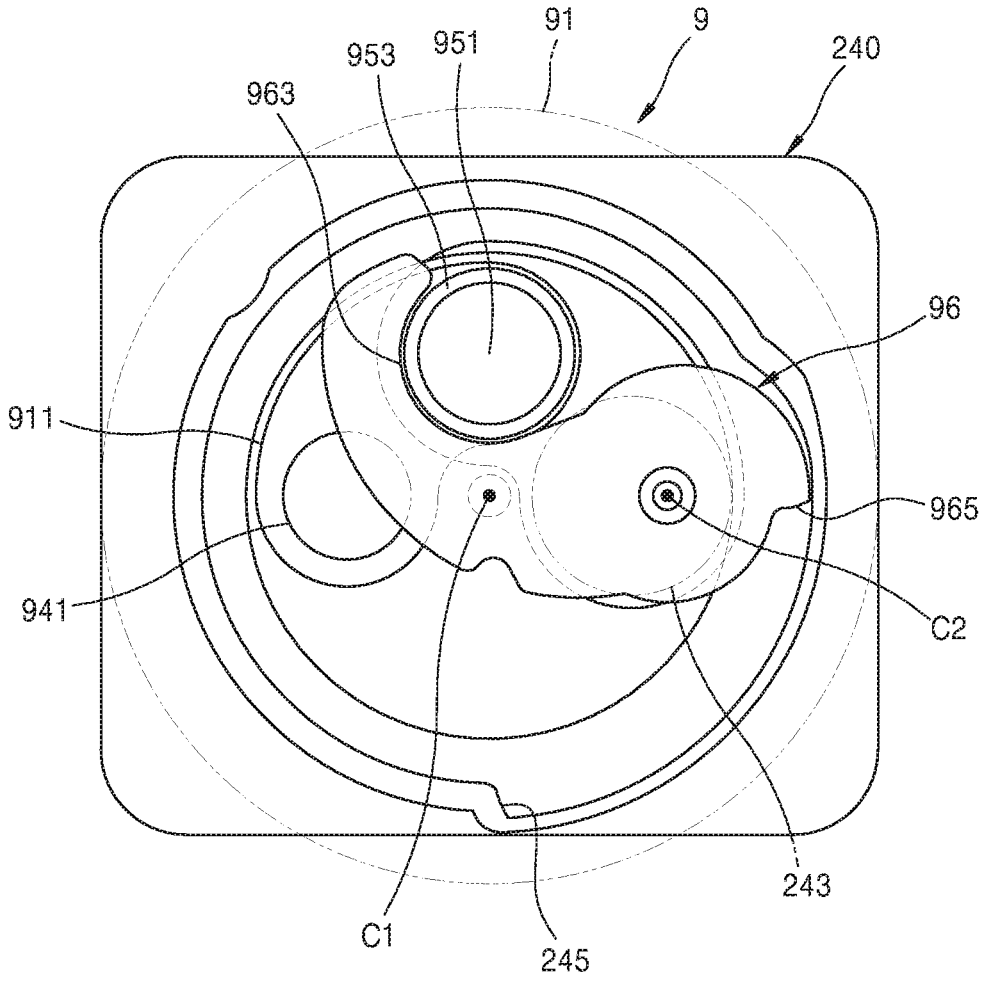
FIG. 11 illustrates an initial state in which a toner cartridge is installed at a toner refilling portion.
Figure 12:
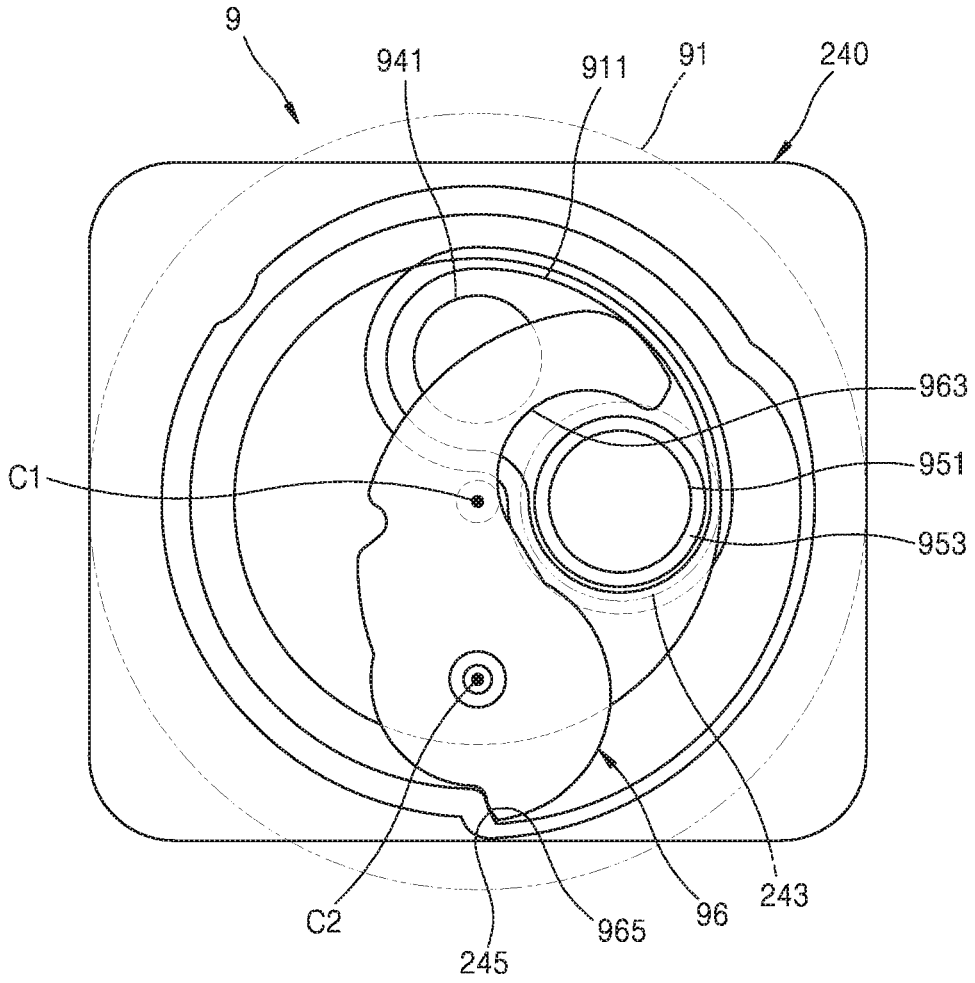
FIG. 12 illustrates a state in which a second toner discharge portion is aligned with a toner inlet portion of a toner refilling portion.
Figure 13:
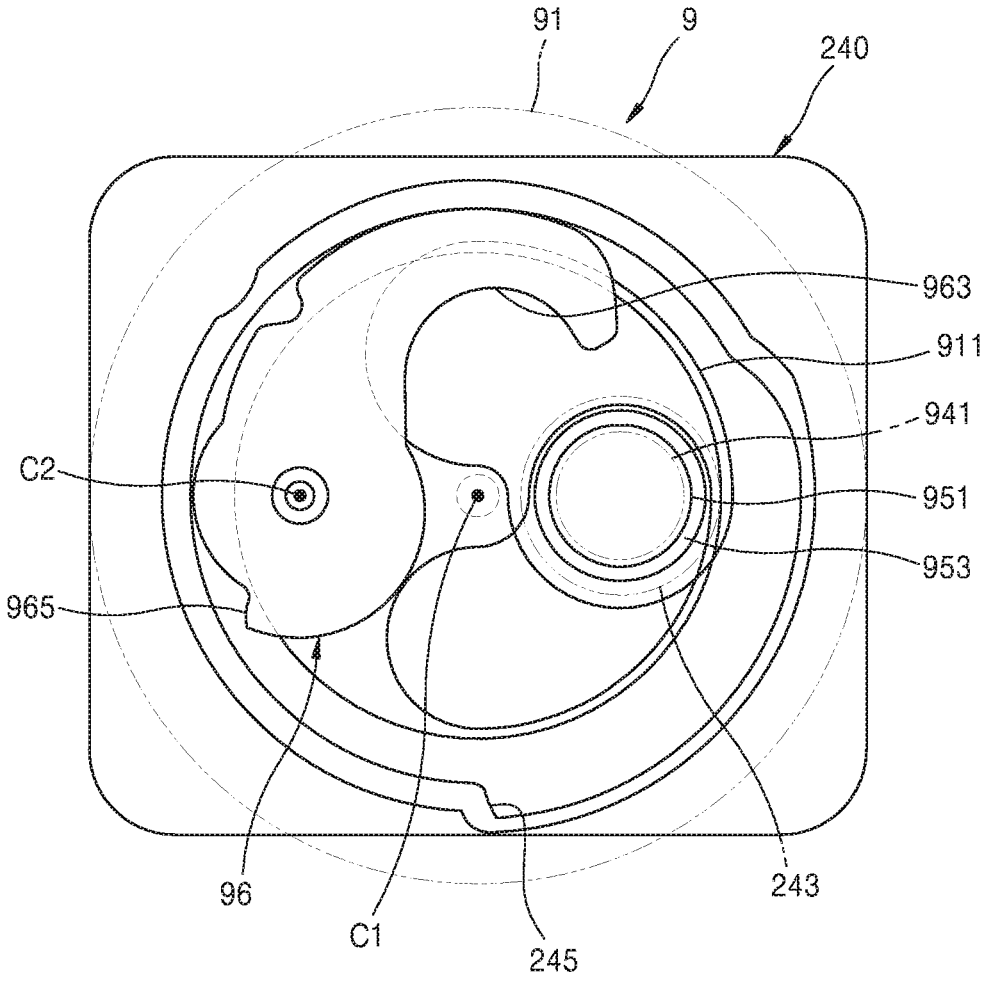
FIG. 13 illustrates a state in which first and second toner discharge portions are aligned with respect to each other.

Hereinafter, an example of a process of filling the toner container 230 with toner by using the above-described toner cartridge 9 will be briefly described. FIG. 11 illustrates an initial state in which the toner cartridge 9 is installed at the toner refilling portion 240. FIG. 12 illustrates a state in which the second toner discharge portion 951 is aligned with a toner inlet portion 243 of the toner refilling portion 240. FIG. 13 illustrates a state in which the first and second toner discharge portions 941 and 951 are aligned with respect to each other.

The discharge shutter 95 is located at the closed position where the first toner discharge portion 941 is not aligned with the second toner discharge portion 951, until the toner cartridge 9 is installed at the toner refilling portion 240. The locking member 96 is located at the locked position to lock the discharge shutter 95 at the closed position. Accordingly, toner leakage may be prevented. In this state, the toner cartridge 9 is inserted into the main body 1 via the communicating portion 8 of the main body 1. Then, as illustrated in FIG. 11, a front portion of the toner cartridge 9 is coupled to the toner refilling portion 240. Since the discharge shutter 95 is locked at the closed position, when the toner cartridge 9 is rotated about the first rotation axis C1, the body 91 and the discharge shutter 95 are rotated along therewith.

When the toner cartridge 9 is rotated at, for example, 90°, as illustrated in FIG. 12, the body 91 and the discharge shutter 95 are rotated along therewith so that the second toner discharge portion 951 is aligned with the toner inlet portion 243 of the toner refilling portion 240. The second toner discharge portion 951 is caught by a stopper (not shown) provided in the toner refilling portion 240, and thus is stopped at a position illustrated in FIG. 12. At this time, the external force receiver 965 of the locking member 96 is caught by the releasing portion 245 provided in the toner refilling portion 240. The locking member 96 escapes from the locked position and is somewhat rotated to the unlocked position. The second interference portion 963 is spaced apart from the first interference portion 953. The intensity of the elastic force applied to the locking member 96 by the locking spring 97 is merely a degree allowing the locking member 96 to return to the locked position from the unlocked position, and thus even while the external force receiver 965 is interfered with the releasing portion 245, a force needed for rotating the toner cartridge 9 is not increased much, and the toner cartridge 9 may be easily rotated.

Since the locking member 96 is located at the unlocked position, the body 91 and the discharge shutter 95 are in a state of being rotatable relative to each other. When the toner cartridge 9 is continuously rotated, the discharge shutter 95 is kept still at the position illustrated in FIG. 12 and the body 91 and the locking member 96 are rotated. In the state illustrated in FIG. 12, for example, when the body 91 is rotated at 90°, as illustrated in FIG. 13, the discharge shutter 95 switches to the discharge position, and thus the first toner discharge portion 941 is aligned with the second toner discharge portion 951. Rotation of the body 91 is restricted by the end portion of the through-hole portion 911, and thus when the discharge shutter 95 is located at the discharge position, the body 91 is no longer rotated.

As illustrated in FIG. 13, the first toner discharge portion 941, the second toner discharge portion 951, and the toner inlet portion 243 are in a communication with one another, and when the plunger 93 is pressed, the toner container 230 may be refilled with toner by the toner flowing from the body 91 to the toner container 230 via the first toner discharge portion 941, the second toner discharge portion 951, and the toner inlet portion 243.

When toner refilling is completed, the toner cartridge 9 is inversely rotated. Then, the body 91 is inversely rotated, and when interference of the external force receiver 965 with the releasing portion 245 is completed, the locking member 96 returns to the locked position by the elastic force of the locking spring 97. The discharge shutter 95 is pushed by the other end portion of the through-hole portion 911 and thus returns to the closed position from the discharge position, and locked by the locking member 96 at the closed position.

The toner cartridge 9 is separated from the toner refilling portion 240 in a state in which the discharge shutter 95 is located at the closed position, and thus residual toner inside the body 91 is not leaked to the outside.

Although the example of the electrophotographic printer to which the toner cartridge 9 is applied has been described with reference to FIGS. 1 to 3, the structure of the printer is not limited to the examples illustrated in FIGS. 1 to 3. Although not shown in the drawings, a toner container (not shown) including the toner refilling portion 240 and connected to the developing cartridge 2 may be provided in the main body 1 of the electrophotographic printer, and the toner cartridge 9 may be used to refill the toner container with toner. In addition, the toner cartridge 9 may be coupled to the toner refilling portion 240 even in a state in which the developing cartridge 2 is detached from the main body 1, thus refilling the developing cartridge 2 with toner. Also, the toner cartridge 9 may be connected to the toner refilling portion 240 in a state in which the toner container is detached from the main body 1, thus refilling the toner container with toner.

While the disclosure has been described with reference to the examples illustrated in the drawings, these examples are provided for illustrative reasons, and it will be understood that various modifications and other examples equivalent thereto can be made. Therefore, the scope of the disclosure should be defined by the following claims.

What is claimed is:

1. A toner cartridge, comprising:

a body to accommodate a toner and including a first toner discharge portion to discharge the toner;

a discharge shutter, including a first interference portion, to rotate relative to the body about a first rotation axis to a discharge position at which the toner is allowed to be discharged via the first toner discharge portion and a closed position at which the toner is prevented from being discharged via the first toner discharge portion; and a locking member including a second interference portion corresponding to the first interference portion, supported by the body, to rotate about a second rotation axis different from the first rotation axis between a locked position and an unlocked position, the locked position being a position where the discharge shutter is at the closed position and the first interference portion is caught by the second interference portion such that the discharge shutter is prevented from rotating, and the unlocked position being a position where the discharge shutter is allowed to rotate, wherein the first rotation axis and the second rotation axis both extend along a longitudinal direction of the body, and when a force is applied to rotate the discharge shutter from the closed position to the discharge position and the locking member is at the locked position, a normal component of a force applied to the second interference portion by the first interference portion is directed in a direction away from a location of the second rotation axis about which the locking member is to rotate.

2. The toner cartridge of claim 1, wherein the second interference portion includes first and second contact portions, the first and second contact portions are to come into contact with the first interference portion, and the second contact portion is to come into contact with the first interference portion at a position spaced apart by 45° or more from a tangential component of the force applied to the second interference portion by the first interference portion.

3. The toner cartridge of claim 2, wherein the second contact portion is to come into contact with the first interference portion at a position spaced apart by about 45° to about 90° from the tangential component.

4. The toner cartridge of claim 3, wherein the first interference portion has a cylindrical shape, and the second interference portion has a partial cylindrical shape connecting the first contact portion to the second contact portion.

5. The toner cartridge of claim 3, wherein the second interference portion includes a first contact surface to come into contact with the first interference portion at the first contact portion, and a second contact surface to come into contact with the first interference portion at the second contact portion.

6. The toner cartridge of claim 1, comprising a locking spring to apply an elastic force to the locking member in a direction in which the locking member returns to the locked position from the unlocked position.

7. The toner cartridge of claim 6, wherein the locking member includes an external force receiver, exposed outside of the body, to receive an external force to switch the locking member to the unlocked position from the locked position.

8. The toner cartridge of claim 1, wherein the first toner discharge portion is eccentrically located with respect to the first rotation axis, and the discharge shutter includes a second toner discharge portion that is not aligned with the first toner discharge portion when the discharge shutter is at the closed position and is aligned with the first toner discharge portion when the discharge shutter is at the discharge position.

9. A toner cartridge, comprising:

a body including a first toner discharge portion to discharge a toner, the body comprising a first body and a second body, wherein the first body is to accommodate the toner and includes the first toner discharge portion;

a discharge shutter, including a first interference portion, to rotate relative to the body about a first rotation axis to a discharge position at which the toner is allowed to be discharged via the first toner discharge portion and a closed position at which the toner is prevented from being discharged via the first toner discharge portion, wherein the first toner discharge portion is eccentrically located with respect to the first rotation axis, the discharge shutter includes a second toner discharge portion that is not aligned with the first toner discharge portion when the discharge shutter is at the closed position and is aligned with the first toner discharge portion when the discharge shutter is at the discharge position, the second body is coupled to the first body such that the discharge shutter is disposed between the second body and the first body, and the second body includes a through-hole portion through which the second toner discharge portion protrudes; and a locking member including a second interference portion corresponding to the first interference portion, supported by the body, to rotate about a second rotation axis different from the first rotation axis between a locked position and an unlocked position, the locked position being a position where the discharge shutter is at the closed position and the first interference portion is caught by the second interference portion such that the discharge shutter is prevented from rotating, and the unlocked position being a position where the discharge shutter is allowed to rotate, and when a force is applied to rotate the discharge shutter from the closed position to the discharge position and the locking member is at the locked position, a normal component of a force applied to the second interference portion by the first interference portion is directed in a direction away from a location of the second rotation axis about which the locking member is to rotate.

10. The toner cartridge of claim 9, wherein the through-hole portion has a circular arc shape to restrict a relative rotation angle of the discharge shutter with respect to the body.

11. The toner cartridge of claim 8, wherein the first interference portion has a cylindrical shape that is concentric with the second toner discharge portion.

12. The toner cartridge of claim 8, wherein the locking member includes a support shaft extending along the second rotation axis and having an end portion rotatably supported by the body, and the discharge shutter includes a support portion to rotatably support another end portion of the support shaft, and having a circular arc shape to allow rotation of the locking member with respect to the first rotation axis.

13. The toner cartridge of claim 8, comprising a sealing member, disposed between the body and the discharge shutter, to rotate together with the discharge shutter and to seal the first toner discharge portion between the closed position and discharge position of the discharge shutter, the sealing member including a through-hole aligned with the second toner discharge portion.

14. A toner cartridge, comprising:

a body to accommodate a toner and including a first toner discharge portion;

a discharge shutter to rotate relative to the body about a first rotation axis between a closed position at which the toner is prevented from being discharged via the first toner discharge portion and a discharge position at which the toner is dischargeable via the first toner discharge portion;

a locking member, supported by the body, to rotate about a second rotation axis different from the first rotation axis between a locked position at which the discharge shutter is locked at the closed position and an unlocked position at which the discharge shutter is allowed to rotate to the discharge position, wherein the first rotation axis and the second rotation axis both extend along a longitudinal direction of the body; and a locking spring to apply to the locking member an elastic force in a direction in which the locking member returns to the locked position, and when a force is applied to rotate the discharge shutter from the closed position to the discharge position and the locking member is at the locked position, a normal component of a force applied to the locking member by the discharge shutter is directed in a direction away from a location of the second rotation axis about which the locking member is to rotate.

15. The toner cartridge of claim 14, wherein the locking member includes an external force receiver, exposed outside of the body, to receive an external force to switch the locking member to the unlocked position from the locked position.

16. The toner cartridge of claim 1, wherein the second interference portion is curved to receive the first interference portion.

17. The toner cartridge of claim 16, wherein the second interference portion has a concave shape to receive a curved outer surface of the first interference portion.

18. The toner cartridge of claim 14, wherein the first toner discharge portion is eccentrically located with respect to the first rotation axis, and the discharge shutter includes a second toner discharge portion that is not aligned with the first toner discharge portion when the discharge shutter is at the closed position and is aligned with the first toner discharge portion when the discharge shutter is at the discharge position.

19. The toner cartridge of claim 18, wherein the body includes a first body and a second body, the first body is to accommodate the toner and includes the first toner discharge portion, the second body is coupled to the first body such that the discharge shutter is disposed between the second body and the first body, and the second body includes a through-hole portion through which the second toner discharge portion protrudes.

20. The toner cartridge of claim 14, wherein the locking member includes a support shaft extending along the second rotation axis and having an end portion rotatably supported by the body, and the discharge shutter includes a support portion to rotatably support another end portion of the support shaft, and having a circular arc shape to allow rotation of the locking member with respect to the first rotation axis.

* * * * *